US006209368B1

(12) United States Patent
Lee

(10) Patent No.: US 6,209,368 B1
(45) Date of Patent: Apr. 3, 2001

(54) COMBINATION LOCK

(76) Inventor: Chin Tsun Lee, No. 32, Alley 6, Kuokuang 7th St., Yung Kang City, Tainan Hsien (TW)

( * ) Notice: Subject to any disclaimer, the term of this patent is extended or adjusted under 35 U.S.C. 154(b) by 0 days.

(21) Appl. No.: 09/391,485

(22) Filed: Sep. 8, 1999

(51) Int. Cl.[7] ..... E05B 37/02

(52) U.S. Cl. ..... 70/312; 70/30; 70/315; 70/DIG. 44

(58) Field of Search ..... 70/25, 26, 30, 70/312, 315–318, 438, DIG. 44

(56) References Cited

U.S. PATENT DOCUMENTS 1,510,635 * 10/1924 Strmic ..... 70/30
4,308,732 * 1/1982 Hau ..... 70/312 X
4,445,348 * 5/1984 Saitoh ..... 70/312
4,733,548 * 3/1988 Ling ..... 70/312 X
5,027,623 * 7/1991 Ling ..... 70/312 X
5,636,539 * 6/1997 Tsai ..... 70/312 X
5,653,136 * 8/1997 Huang ..... 70/312
5,715,709 * 2/1998 Lai ..... 70/312 X
5,899,099 * 5/1999 Tsai ..... 70/312 X
5,934,120 * 8/1999 Kuo ..... 70/312

* cited by examiner

*Primary Examiner*—Suzanne Dino Barrett
(74) *Attorney, Agent, or Firm*—Rosenberg Klein & Lee

(57) ABSTRACT

A combination lock includes a male lock body including a rod a female lock body. The female lock body includes a column having a longitudinal slit for releasably receiving the rod of the male lock body. A number of resilient sleeves mounted are around the column. Each sleeve includes a central hole through which the rod extends. Each sleeve includes a bulge on an outer periphery thereof. A number of number wheels are mounted around the column. Each number wheel receives an associated sleeve therein. The bulge of each sleeve generates a sound when the associated number wheel is rotated.

6 Claims, 7 Drawing Sheets

COMBINATION LOCK

BACKGROUND OF THE INVENTION

1. Field of the Invention

The present invention relates to a combination lock that may prevent inadvertent change in the unlocking code. The present invention also relates to a combination lock that has a better rotational positioning effect for each number wheel and that provides a sound for indicating rotation of each number wheel.

2. Description of the Related Art

Combination locks provide a convenient tool for users, as keys are not necessary. Traditional combination locks have fixed unlocking code when manufactured and are thus easily unlocked by unauthorized individuals. FIG. 6 of the drawings illustrates a conventional lock allowing change in the unlocking code. The lock has a male lock body 1' and a female lock body 2'. The female lock body 2' includes a recessed chamber 21' in a first side thereof and a groove 22' in a second side thereof. A stem 23' extends from the first side of the female lock body 2' for mounting an elastic element 24', a number of slide sleeves 25', a number of positioning resilient plates 26', a number of retainer plates 27', a number of number wheels 28', a control slide sleeves 29', and an end cap 20'. Each retainer plate 27' has a slit 271' and a number of teeth 272' on a side thereof. Each number wheel 28' has a number of annularly disposed engaging grooves 281'.

FIG. 7 illustrates a sectional view of the combination lock in FIG. 6. When change in the unlocking code is required, the control sleeve 29' is actuated to move the retainer plates 27' and slide sleeves 25. The teeth 272' on each retainer plate 27' disengage from the engaging grooves 281' of the associated number wheel 28', thereby allowing adjustment in the unlocking code by rotating the number wheels 28'.

Nevertheless, the above-mentioned adjustment can be proceeded even though the combination lock is in a locked status (i.e., the slits 271' of the retainer plates 27' are not aligned with each other). As a result, the user may not know the correct new unlocking code. In addition, the adjustment is inconvenient to the user, as the user has to exert a continuous force to the control sleeve 29' until the new unlocking code is set. In addition, the teeth 272' of each retainer plate 27' may be not completely disengaged from the engaging holes 281' of the associated number wheel 28' and thus result in malfunction of the combination lock, as the correct unlocking code cannot be known. Assembly of the combination lock is time-consuming and inconvenient, as a slide sleeve 25', a positioning resilient plate 26', and a retainer plate 27' are required for each number wheel 28'.

FIGS. 8 and 9 of the drawings illustrate a positioning plate 3' for a combination lock. The positioning plate 3' includes a recessed section 31' and a channel 32' for holding an elastic element 33' having an end 331' that will produce a sound when impinged by an inner periphery of an associated number wheel 4'. It is, nevertheless, found that the elastic element 33' is apt to be disengaged from the positioning plate 3'.

The present invention is intended to provide a combination lock that mitigates and/or obviates the above problems.

SUMMARY OF THE INVENTION

It is a primary object of the present invention to provide a combination lock to prevent inadvertent change in the unlocking code.

It is another object of the present invention to a provide combination lock that has a better rotational positioning effect for each number wheel.

It is a further object of the present invention to provide a combination lock that provides a sound for indicating rotation of each number wheel.

In accordance with a first aspect of the invention, a combination lock comprises:

a male lock body including a rod with a plurality of longitudinally spaced teeth formed thereon; and a female lock body including:

a column having a longitudinal slit for releasably receiving the rod of the male lock body, the column including a plurality of pairs of protrusions on two lateral sides thereof, a plurality of sleeves mounted around the column, each said sleeve including a central hole with a notched section through which the rod of the male lock body extends, a periphery defining the central hole of each said sleeve including a pair of grooves for releasably engaging with one of the pairs of protrusions of the column, a plurality of retainer plates mounted around the column, each said retainer plate including a central hole with a notched section through which the rod of the male lock body extends, a periphery defining the central hole of each said retainer plate including a pair of grooves for releasably engaging with one of the pairs of protrusions of the column, a plurality of number wheels mounted around the column, each said retainer plate being releasably engaged with an associated said number wheel to rotate therewith, an elastic element mounted around an end of the column for biasing each said retainer plate to engage with the associated number wheel to rotate therewith; and means for actuating each said retainer plate to disengage from the associated number wheel for allowing a change in unlocking code for the combination lock, the actuating means being operable only when the combination lock is in an unlocked status in which the grooves of each said retainer plate align with the protrusions of the column.

In accordance with a second aspect of the invention, a combination lock comprises:

a male lock body including a rod with a plurality of longitudinally spaced teeth formed thereon; and a female lock body including:

a column having a longitudinal slit for releasably receiving the rod of the male lock body, the column including an engaging section, a plurality of resilient sleeves mounted around the column, each said sleeve including a central hole through which the rod of the male lock body extends, a plurality of retainer plates mounted around the column, each said retainer plate including a central hole through which the rod of the male lock body extends, a plurality of number wheels mounted around the column, each said retainer plate being releasably engaged with an associated said number wheel to rotate therewith, an elastic element mounted around an end of the column for biasing each said retainer plate to engage with the associated number wheel to rotate therewith;

an actuating ring mounted around the column and including a central hole with a notched section through which the rod of the male lock body extends, a periphery defining the central hole of the actuating ring including a recessed section for engaging with the engaging section of the column to thereby prevent rotation of the actuating ring, the actuating ring further including a push section on a side thereof, the push section bearing against an adjacent said retainer plate, the actuating ring further including a projection formed on the other side thereof, and a turn cap rotatably mounted around the column, the turn cap including a central hole with a notched section through which the rod of the male lock body extends, a periphery defining the central hole of the turn cap including an inclined slide groove having two recessed ends for releasably engaging with the projection of the actuating ring, thereby retaining the actuating ring in place, the projection of the actuating ring being slidable along the inclined slide groove upon rotation of the turn cap such that the actuating ring moves longitudinally to actuate the retainer plates to disengage from the number wheels, thereby allowing change in unlocking code of the combination lock.

A stopping portion may be formed adjacent to one of the recessed ends of the inclined guide groove.

In accordance with a third aspect of the invention, a combination lock comprises:

a male lock body including a rod with a plurality of longitudinally spaced teeth formed thereon; and a female lock body including:

a column having a longitudinal slit for releasably receiving the rod of the male lock body, the column further including an engaging section, a plurality of resilient sleeves mounted around the column, each said sleeve including a central hole through which the rod of the male lock body extends, a periphery defining the central hole of one of said sleeves including a recessed section for engaging with the engaging section of the column, each said sleeve further including a bulge on an outer periphery thereof, and a plurality of number wheels mounted around the column, each said number wheel receiving an associated said sleeve therein, whereby the bulge of each said sleeve generates a sound when an associated said number wheel is rotated.

The bulge may further include an opening therein.

Each number lock further includes a compartment with an inner periphery for receiving the associated said sleeve. The inner periphery includes a plurality of alternatively disposed convex portions and retaining grooves, wherein the bulge is releasably retained in one of the retaining grooves.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
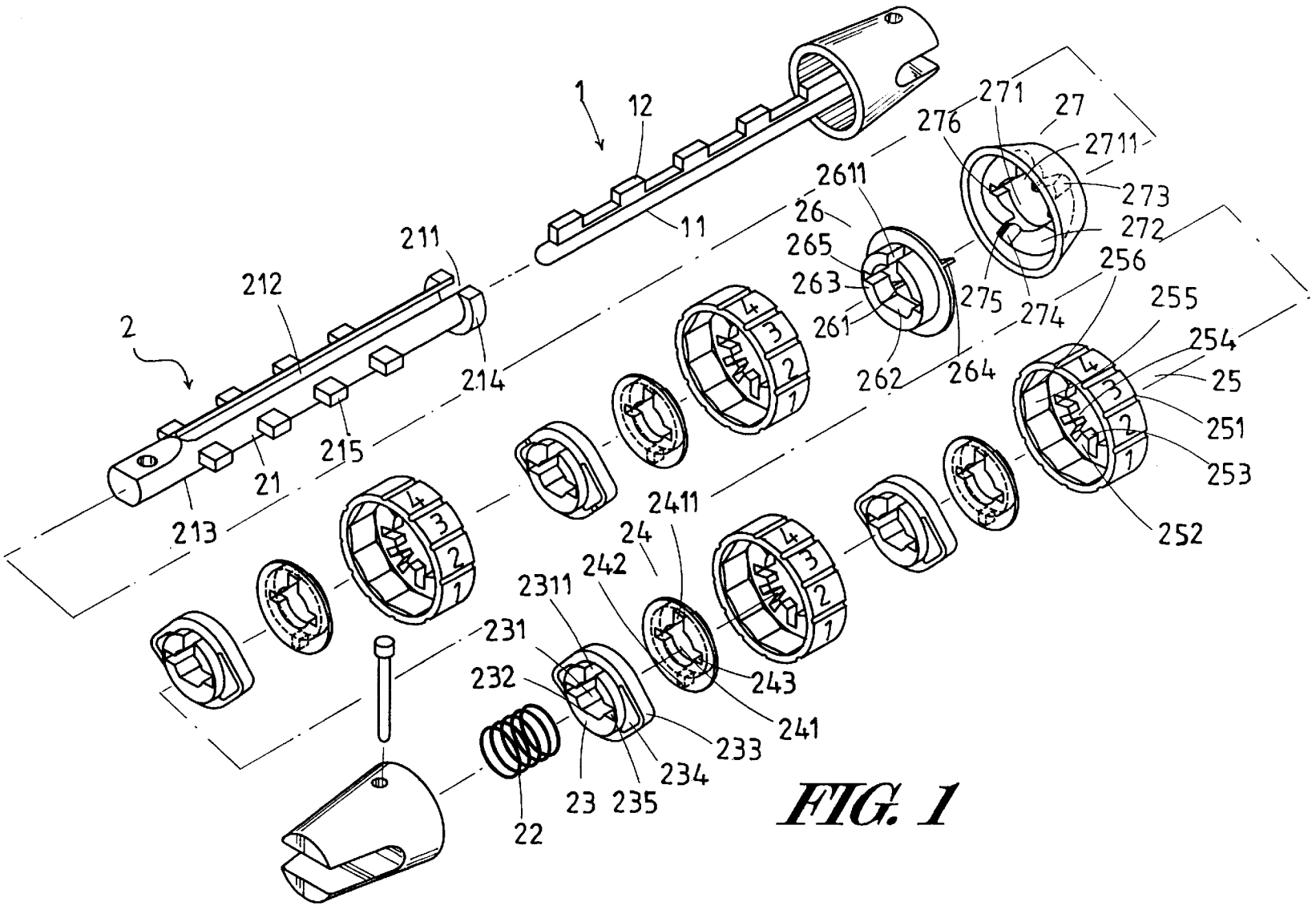
FIG. 1 is an exploded perspective view of a combination lock in accordance with the present invention.
Figure 2:
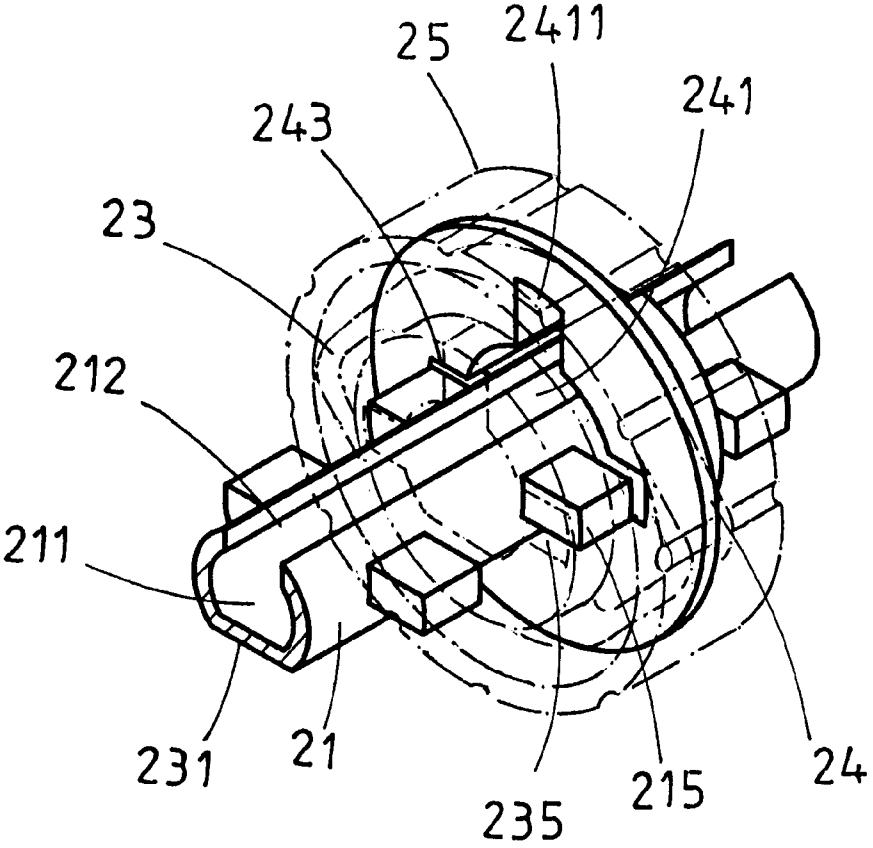
FIG. 2 is a partial perspective view of the combination lock in accordance with the present invention.
Figure 3:
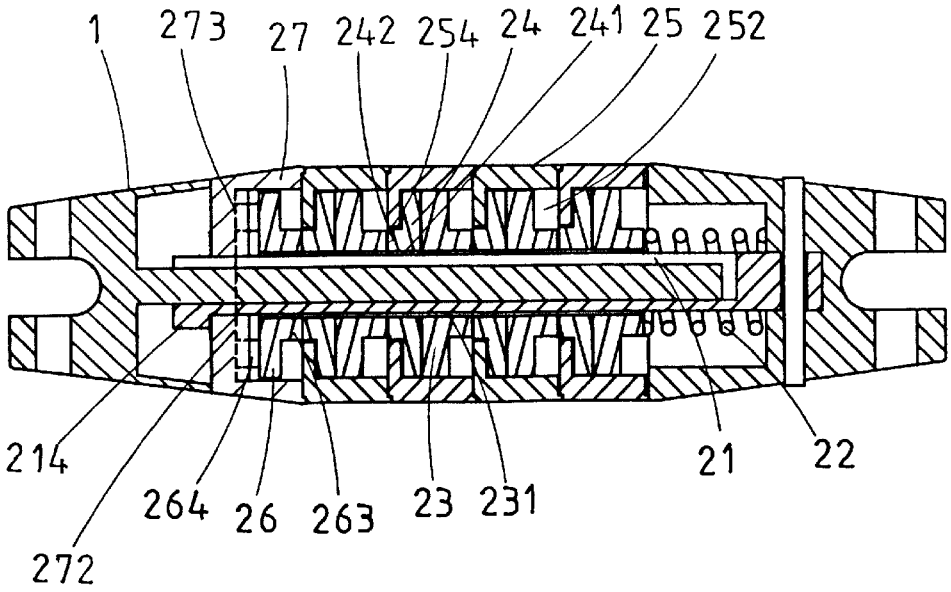
FIG. 3 is a sectional view of the combination lock in accordance with the present invention.

Referring to FIGS. 1 through 5 and initially to FIGS. 1 through 3, a combination lock in accordance with the present invention generally includes a male lock body 1 and a female lock body 2. The male lock body 1 includes a rod 11 with a number of longitudinally spaced teeth 12 formed thereon. The female lock body 2 includes a column 21 with a longitudinal slit 212 having an opening 211 in an end face of the column 21 through which the rod 11 is inserted into the longitudinal slit 212. A number of pairs of protrusion 215 are formed on lateral sides of the column 21. A flat engaging section 213 is formed on the other end of the column 21 opposite to the opening 211. The female lock body 2 further includes an elastic element 22, a number of resilient sleeves 23, a number of retainer plates 24, a number of number wheels 25, an actuating ring 26, and a turn cap 27.

The elastic element 22 is mounted around the other end of the column 21 and includes an end attached to a respective adjacent resilient sleeve 23. Each resilient sleeve 23 is made of flexible material and includes a central hole 231 with a notched section 2311 through which the rod 11 extends. A periphery defining the central hole 231 includes a recessed section 232 for engaging with the flat engaging section 213 of the column 21. The periphery defining the central hole 231 further includes a pair of grooves 235 for engaging with one pair of the protrusions 215 of the column 21, thereby preventing rotation of the resilient sleeve 23. Each resilient sleeve 23 further includes two diametrically disposed bulges 233 on an outer periphery thereof, each bulge 233 having an opening 234 therein. The openings 234 increase flexibility of the bulges 233.

Each retainer plate 24 is substantially circular and includes a central hole 241 with a notched section 2411 through which the rod 11 extends. A periphery defining the central hole 241 includes an engaging section 242 which will be described later. The periphery defining the central hole 241 further includes a pair of grooves 243 for engaging with one pair of the protrusions 215 of the column 21. More specifically, the protrusions 215 assure alignment of the notched sections 2411 of the retainer plates 24 for allowing longitudinal movement of the retainer plate only when the number wheels 25 are in their unlocking position. The protrusion 215 also prevents rotation of the resilient sleeves 23 and the actuating ring 26.

An outer periphery of each number wheel 25 includes a plurality of annularly arranged numbers (generally 0–9) that are spaced by a notch or groove 251. Each number wheel 25 includes a central hole (not labeled). A periphery defining the central hole includes an engaging section 252 with a plurality of teeth 253 (spaced by grooves 254) that are arranged corresponding to positions of the grooves 251, wherein a groove 254 engages with the recessed section 242 of an associated retainer plate 24 to allow the retainer plate 24 to rotate together with the number wheel 25. Each number wheel 25 further includes a compartment communicated with the central hole thereof, the compartment being defined by an inner periphery consisting of alternatively disposed convex portions 255 and retaining grooves 256. Two diametrically disposed retaining grooves 256 receive the end portions of the bulges 233 of an associated resilient sleeve 23. Thus, when the number wheel 25 is rotated from a number (e.g., 3) to another (e.g., 4), the bulges 233 generate a sound as a result of impact of the bulge 233 by the convex portions 255.

The actuating ring 26 includes a central hole 261 with a notched section 2611 through which the rod 11 extends. A periphery defining the central hole 261 includes a recessed section 262 for engaging with the flat engaging section 213 of the column 21. The periphery defining the central hole 261 further includes a pair of grooves 265 for engaging with one pair of the protrusions 215 of the column 21. Formed on a side of the actuating ring 26 is includes a push section 263 that bears against an outermost retainer sleeve 24. The other side of the actuating ring 26 includes a projection 264 that will be described later.

The turn cap 27 includes central hole 271 with a notched section 2711 through which the rod 11 extends. A periphery defining the central hole 271 includes a recessed section 276 for engaging with the flat engaging section 213 of the column 21. The periphery defining the central hole 271 further includes an inclined slide groove 272 having two recessed ends 273 and 274 and a stopping portion 275. The inclined slide groove 272 may engage with the projection 264 of the actuating ring 26 such that rotation of the turn cap 27 causes movement of the projection 264 along the inclined slide groove 272 to the stopping portion 275 and thus positioned by the recessed end 274. In addition, the actuating ring 26 is moved longitudinally to disengage each retainer plate 24 from the engaging section 254 of the associated number wheel 25, thereby allowing change in the unlocking code.

As illustrated in FIGS. 2 and 3, each resilient sleeve 23 and associated retainer plate 24 and number wheel 25 are mounted around the column 21 to form a unit, wherein the engaging section 242 of the retainer plate 24 engages with one of the groove 254 of the number wheel 25 so as to rotate together. The actuating ring 26 and the turn cap 27 are mounted to an end of the column 21, wherein the inclined slide groove 272 receives the projection 264 of the actuating ring 26. As illustrated in FIG. 2, when the grooves 243 of each retainer plate 24 align with the projections 215 of the column 21, the notched section 2411 of each retainer plate 24 is aligned with the longitudinal slit 212 of the column 21. Namely, the combination lock is in an unlocked position. When the grooves 243 of one of the retainer plates 24 do not align with the projections 215 of the column, the notched section 2411 of the retainer plate 24 is not aligned with the longitudinal slit 212 of the column 21. Namely, the combination lock is in a locked position and the retainer plate 24 is not movable longitudinally. In addition, the protrusions 215 on two sides of the column 21 have different sizes such that the notched section 2411 is in the unlocking position only when the correspondingly sized grooves 243 of each retainer plate 24 are aligned with the protrusions 215.

Figure 4:
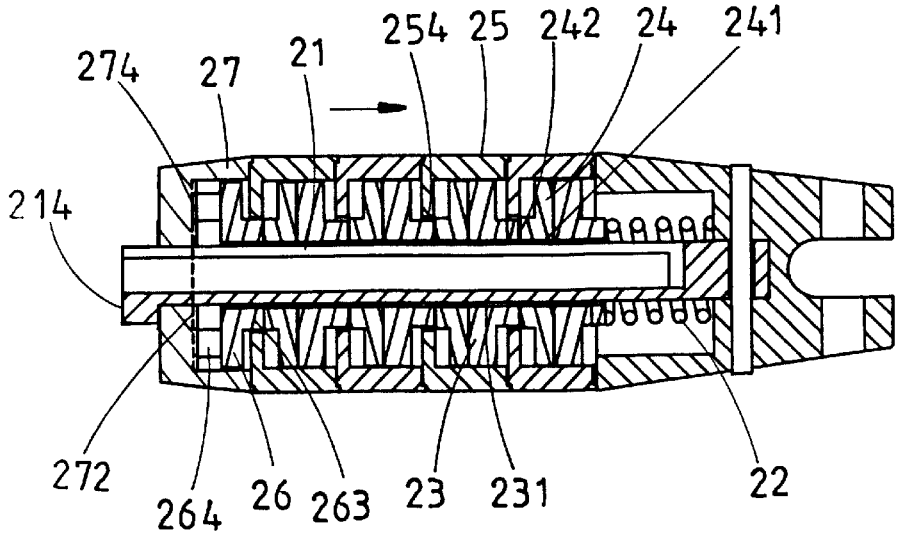
FIG. 4 is a sectional view similar to FIG. 3, illustrating change in the unlocking code.

Referring to FIG. 4, when the user intends to change the unlocking code, the number wheels 25 are rotated to the unlocking code in which the recessed sections 243 of each retainer plate 24 align with the protrusions 215 of the column 21. The turn cap 27 is then turned to cause the projection 264 of the actuating ring 26 to slide along the inclined slide groove 272 until it is stopped by and retained in the recessed end 273. The push section 263 of the actuating ring 26 urges the retainer plates 24 to move longitudinally such that the engaging section 242 of each retainer plate 24 disengages from the engaging section 252 of the associated number wheel 25, thereby allowing change in the unlocking code. After such change, the turn cap 27 is turned in the reverse direction such that the projection 264 of the actuating ring 26 slides along the inclined slide groove 272 until it is stopped by the stopping section 275 and retained in the recessed end 274. The retainer plates 24 are moved longitudinally under the action of the elastic element 22 such that the engaging section 242 of each retainer plate 24 re-engages with the engaging section 252 of the associated number wheel 25.

It is noted that the turn cap 27 is not rotatable when the recessed sections 243 of one of the retainer plates 24 are not aligned with the protrusions 215, since the retainer plate 24 is stopped by the protrusions 215 of the column 21 and thus not rotatable. Thus, change in the unlocking code can be proceeded only when the combination lock is in its unlocking position.

Figure 5:
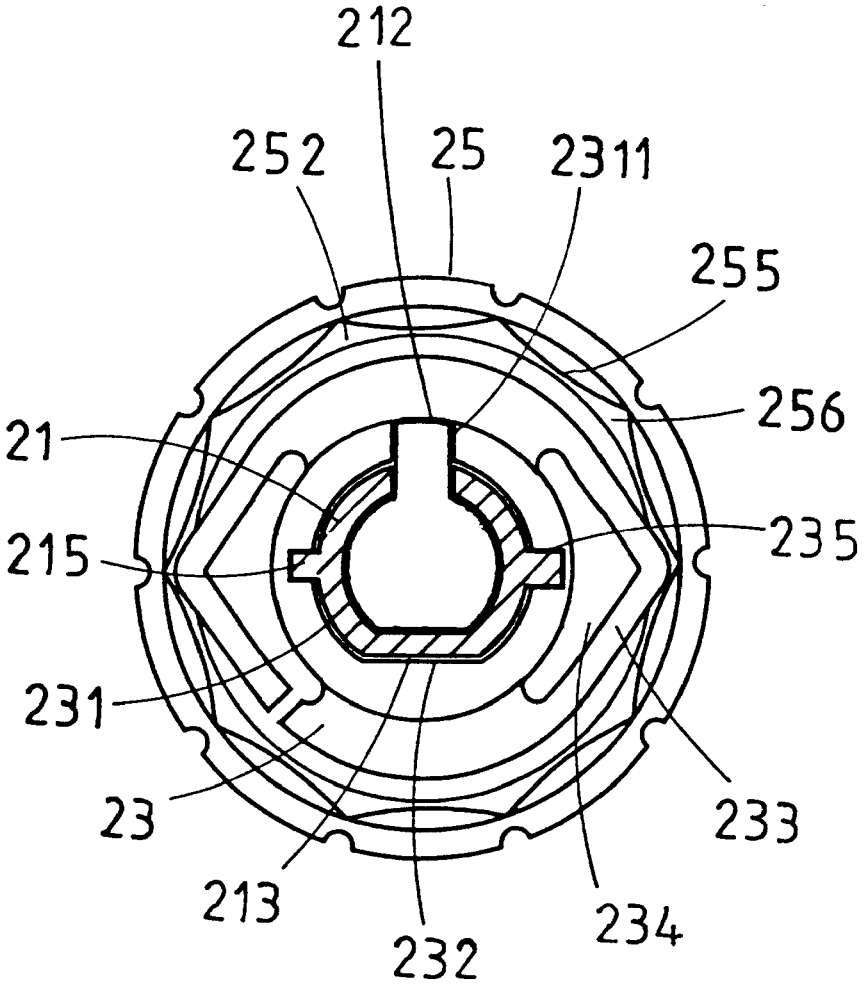
FIG. 5 is a sectional view illustrating engagement between a number wheel and an associated resilient sleeve.
Figure 6:
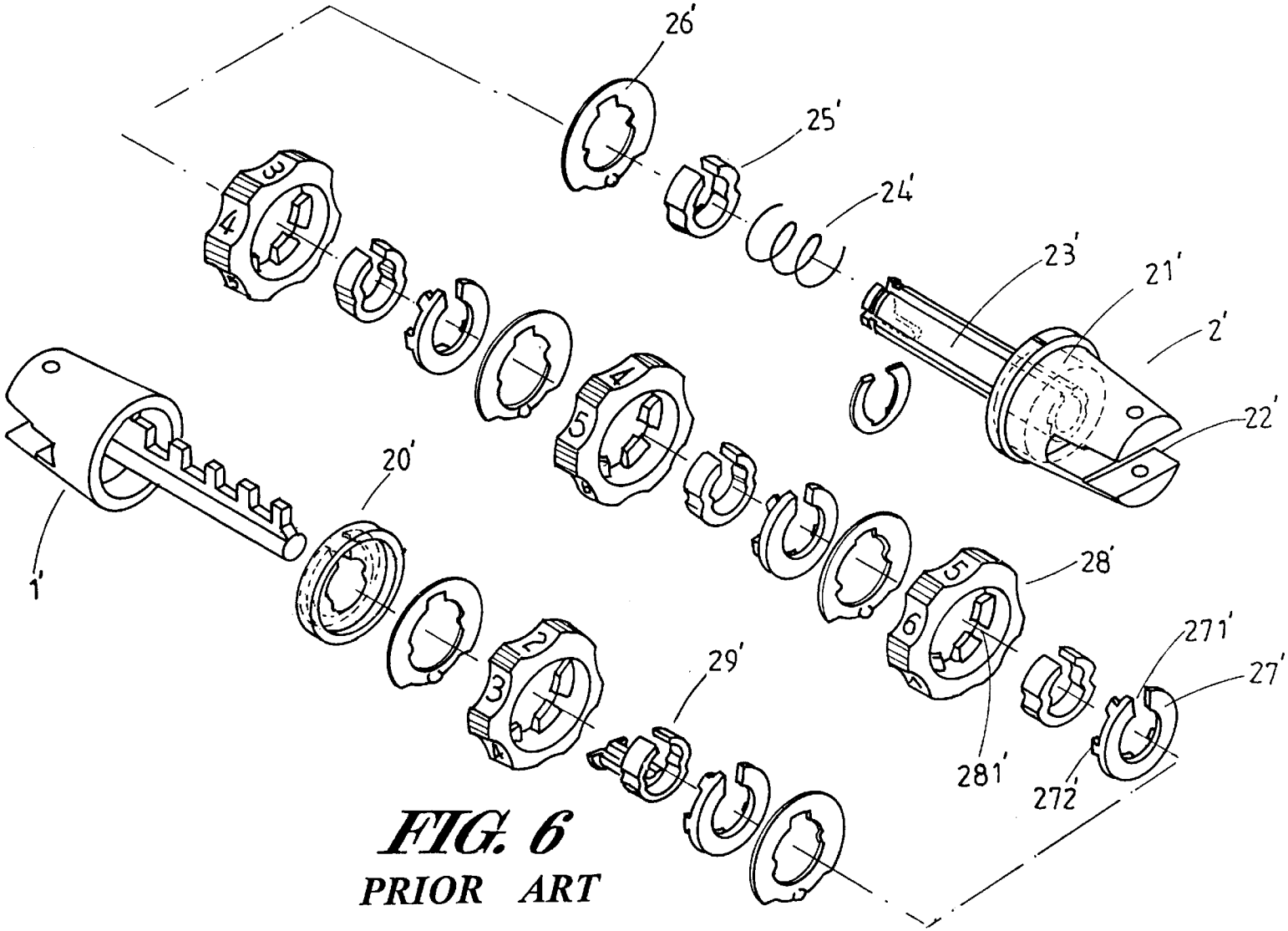
FIG. 6 PRIOR ART
FIG. 6 is an exploded view of a conventional combination lock.
Figure 7:
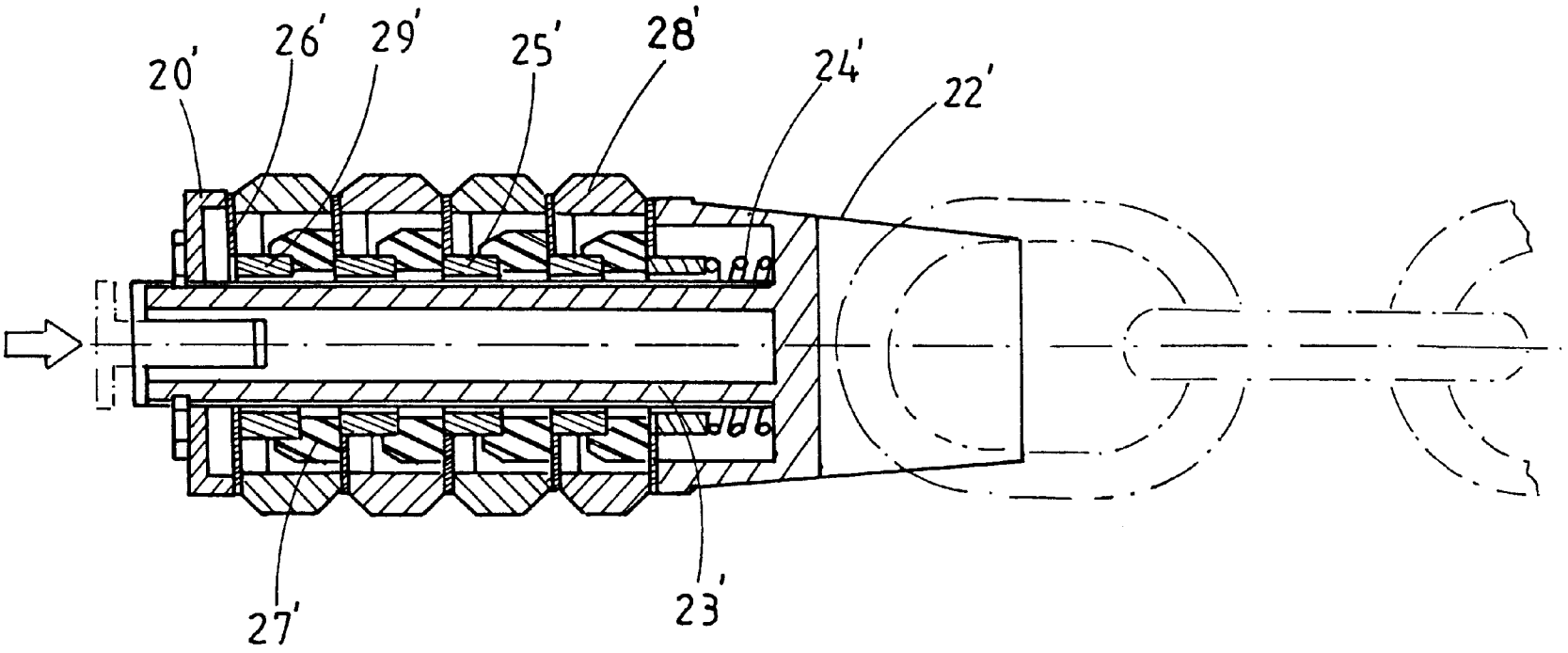
FIG. 7 PRIOR ART
FIG. 7 is a sectional view of the combination lock in FIG. 6.

Referring to FIG. 5, because each resilient sleeve 23 includes a recessed section 232 for engaging with the flat engaging section 213 of the column 21 and because the grooves 235 of each resilient sleeve 23 engage with an associated pair of protrusions 215 on the column 21, the resilient sleeve 23 is not rotatable relative to the column 21. The bulges 233 on each resilient sleeve 23 are impinged by the associated number wheel 25 and thus generate a sound to provide indication of position of the number wheel 25. In addition, the bulge 233 may be retained in the retaining grooves 256. The openings 234 increase resiliency of the bulges 233.

According to the above description, it is appreciated that the combination lock of the present invention has the following advantages:

(1) Change in the unlocking code can be proceeded only when the combination lock is in its unlocked status. The correct unlocking code can be recognized.

(2) Change in the unlocking code can be proceeded without continuously holding the turn cap, as the actuating ring 26 is provided with a projection 264 for engaging with recessed end 273 of the turn cap 27.

(3) the total number of elements of the combination lock of the invention is less than that for conventional combination locks and thus is more convenient to assembly procedure and reduces the malfunction possibility.

Figure 8:
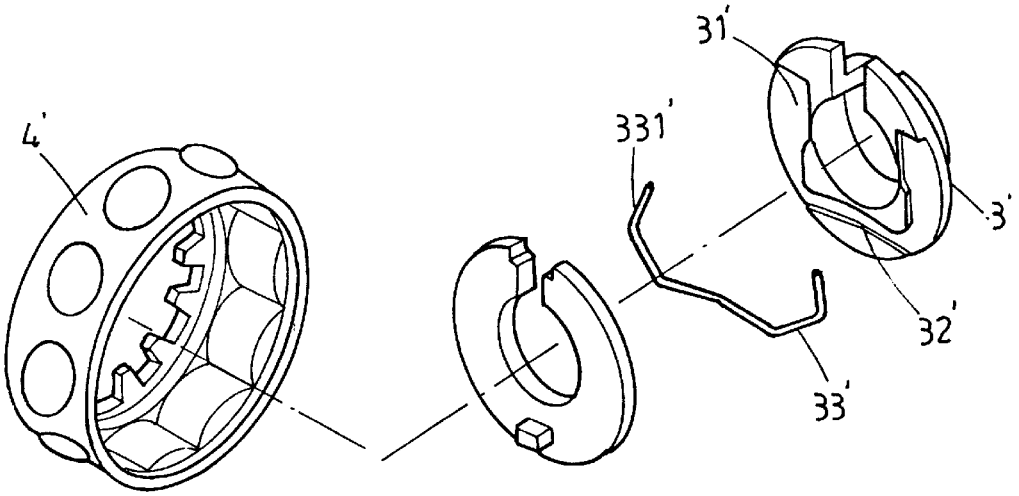
FIG. 8 PRIOR ART
FIG. 8 is an exploded perspective view of a number wheel and an associated positioning sleeve of another combination lock.
Figure 9:
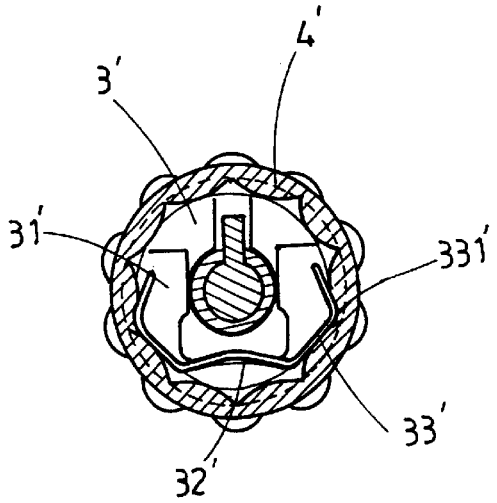
FIG. 9 PRIOR ART
FIG. 9 is a sectional view illustrating engagement between the number wheel and the positioning sleeve in FIG. 8.

(4) The resilient sleeve 23 of the invention is integrally formed and includes the advantages of positioning function, sound generation, and easy assembly. This prevents the disadvantage of easy disengagement of the elastic element in FIG. 8.

Although the invention has been explained in relation to its preferred embodiment, it is to be understood that many other possible modifications and variations can be made without departing from the spirit and scope of the invention as hereinafter claimed.

What is claimed is:

1. A combination lock comprising:

a male lock body (1) including a rod (11) with a plurality of longitudinally spaced teeth (12) formed thereon; and a female lock body (2) including:

a column (21) having a longitudinal slit (212) for releasably receiving the rod (11) of the male lock body (1), the column (21) including a plurality of pairs of protrusions (215) on two lateral sides thereof, a plurality of sleeves (23) mounted around the column (21), each said sleeve (23) including a central hole (231) with a notched section (2311) through which the rod (11) of the male lock body (1) extends, a periphery defining the central hole (231) of each said sleeve (23) including a pair of grooves (235) for releasably engaging with one of the pairs of protrusions (215) of the column (21), a plurality of retainer plates (24) mounted around the column (21), each said retainer plate (24) including a central hole (241) with a notched section (2411) through which the rod (11) of the male lock body (1) extends, a periphery defining the central hole (241) of each said retainer plate (24) including a pair of grooves (243) for releasably engaging with one of the pairs of protrusions (215) of the column (21), a plurality of number wheels (25) mounted around the column (21), each said retainer plate (24) being releasably engaged with an associated said number wheel (25) to rotate therewith, an elastic element (22) mounted around an end of the column (21) for biasing each said retainer plate (24) to engage with the associated number wheel (25) to rotate therewith; and means for actuating each said retainer plate (24) to disengage from the associated number wheel (25) for allowing a change in unlocking code for the combination lock, the actuating means being operable only when the combination lock is in an unlocked status in which the grooves (243) of each said retainer plate (24) align with the protrusions (215) of the column (21).

2. A combination lock comprising:

a male lock body (1) including a rod (11) with a plurality of longitudinally spaced teeth (12) formed thereon; and a female lock body (2) including:

a column (21) having a longitudinal slit (212) for releasably receiving the rod (11) of the male lock body (1), the column (21) including an engaging section (213), the column (21) having formed on opposing lateral sides thereof a plurality of longitudinally spaced protrusions (215), a plurality of resilient sleeves (23) mounted around the column (21), each said sleeve (23) including a central hole (231) through which the rod (11) of the male lock body (1) extends, a plurality of retainer plates (24) mounted around the column (21), each said retainer plate (24) including a central hole (241) through which the rod (11) of the male lock body (1) extends, a plurality of number wheels (25) mounted around the column (21), each said retainer plate (24) being releasably engaged with an associated said number wheel (25) to rotate therewith, an elastic element (22) mounted around an end of the column (21) for biasing each said retainer plate (24) to engage with the associated number wheel (25) to rotate therewith;

an actuating ring (26) mounted around the column (21) and including a central hole (261) with a notched section (2611) through which the rod (11) of the male lock body (1) extends, a periphery defining the central hole (261) of the actuating ring (26) including a recessed section (262) for engaging with the engaging section (213) of the column (21) to thereby prevent rotation of the actuating ring (26), the actuating ring (26) further including a push section (263) on a side thereof, the push section (263) bearing against an adjacent said retainer plate (24), the actuating ring (26) further including a projection (264) formed on the other side thereof, and a turn cap (27) rotatably mounted around the column (21), the turn cap (27) including a central hole (271) with a notched section (2711) through which the rod (11) of the male lock body (1) extends, a periphery defining the central hole (271) of the turn cap (27) including an inclined slide groove (272) having two recessed ends (273 and 274) for releasably engaging with the projection (264) of the actuating ring (26), thereby retaining the actuating ring (26) in place, the projection (264) of the actuating ring (26) being slidable along the inclined slide groove (272) upon rotation of the turn cap (27) such that the actuating ring (26) moves longitudinally to actuate the retainer plates (24) to disengage from the number wheels (25), thereby allowing change in unlocking code of the combination lock.

3. The combination lock as claimed in claim 2, further comprising a stopping portion (275) formed adjacent to one of the recessed ends (273 and 274) of the inclined guide groove (272).

4. A combination lock comprising:

a male lock body (1) including a rod (11) with a plurality of longitudinally spaced teeth (12) formed thereon; and a female lock body (2) including:

a column (21) having a longitudinal slit (212) for releasably receiving the rod (11) of the male lock body (1), the column (21) further including an engaging section (213), a plurality of resilient sleeves (23) mounted around the column (21), each said sleeve (23) including a central hole (231) through which the rod (11) of the male lock body (1) extends, a periphery defining the central hole (231) of one of said sleeves (23) including a recessed section (232) protruding axially from an outer periphery thereof, the recessed section (232) coaxially encircling the engaging section (213) of the column (21), said outer periphery of each said sleeve (23) defining at least one radially protruding bulge (233), and a plurality of number wheels (25) mounted around the column (21), each said number wheel (25) receiving an associated said sleeve (23) therein, whereby the engagement of the bulge (233) of each said sleeve (23) with an associated said number wheel (25) upon the rotation thereof generates a sound.

5. The combination lock as claimed in claim 4, wherein the bulge (233) further includes an opening (234) therein.

6. The combination lock as claimed in claim 4, wherein each said number wheel (25) further includes a compartment with an inner periphery for receiving the associated said sleeve (23), the inner periphery including a plurality of alternatively disposed convex portions (255) and retaining grooves (256), wherein the bulge (233) is releasably retained in one of the retaining grooves (256).

* * * * *